US008991493B2

(12) United States Patent
Chang

(10) Patent No.: US 8,991,493 B2
(45) Date of Patent: Mar. 31, 2015

(54) MULTI-STAGE ENHANCED OIL RECOVERY PROCESS

(75) Inventor: Harry L. Chang, Plano, TX (US)

(73) Assignee: Chemor Tech International, LLC, Plano, TX (US)

( * ) Notice: Subject to any disclaimer, the term of this patent is extended or adjusted under 35 U.S.C. 154(b) by 324 days.

(21) Appl. No.: 13/534,912

(22) Filed: Jun. 27, 2012

(65) Prior Publication Data

US 2014/0000885 A1 Jan. 2, 2014

(51) Int. Cl.
*E21B 43/24* (2006.01)

(52) U.S. Cl.
CPC ..... *E21B 43/24* (2013.01)
USPC ..... 166/272.1; 166/272.3; 166/270.1; 166/400

(58) Field of Classification Search
CPC ..... E21B 43/24; E21B 43/16; C09K 8/584
USPC ..... 166/272.1, 272.3, 272.6, 270.1, 270.2, 166/400
See application file for complete search history.

(56) References Cited

U.S. PATENT DOCUMENTS 3,780,808 A * 12/1973 Christopher et al. ..... 166/275
3,927,716 A 12/1975 Burdyn et al.
3,929,190 A 12/1975 Chang et al.
3,977,470 A 8/1976 Chang
4,004,638 A 1/1977 Burdyn et al.
4,008,796 A 2/1977 Aylon
4,018,281 A * 4/1977 Chang ..... 166/270.1
4,548,268 A 10/1985 Stipanovic
4,773,484 A 9/1988 Chang et al.
5,285,848 A 2/1994 Chang

OTHER PUBLICATIONS

"Enhanced Oil Recovery / CO2 Injection", Fossil Energy Office of Communications, Page updated on Dec. 12, 2011, U.S. Department of Energy, URL www.fossil.energy.gov/programs/oilgas/eor/index.html.
"Enhanced Oil Recovery (EOR)", Teledyne Isco, Inc., Page last modified on Nov. 27, 2007, URL www.isco.com/WebProductFiles/Applications/105/Application_Notes/Enhanced_Oil_Recovery.pdf.
Watkins, Catherine, "Chemically enhanced oil recovery stages a comeback", Nov. 2009.

(Continued)

*Primary Examiner* — Zakiya W Bates
*Assistant Examiner* — Silvana Runyan
(74) *Attorney, Agent, or Firm* — David W. Carstens; Shaukat A. Karjeker; Carstens & Cahoon, LLP

(57) ABSTRACT

Multi-stage methods for the enhanced recovery of high viscosity oil deposits from low temperature, shallow subterranean formations. The methods may include the steps of heating potentially extractable hydrocarbons, such as high viscosity oil, by injecting a sufficient amount of a heating fluid having a temperature and viscosity sufficiently high to minimize channeling and to permit penetration into regions of the reservoir containing the potentially extractable hydrocarbons. Thereafter, there is injected an extraction fluid that forms a mobile emulsion with the oil, without need for a co-solvent. The extraction fluid may include either a surfactant-polymer formulation or an alkaline-surfactant-polymer formulation. This is followed by injecting a polymer drive medium into the reservoir to displace and drive hydrocarbons and fluids comprising oil to a production well. An aqueous driving medium is then injected into the reservoir to also drive hydrocarbons and fluids comprising oil to a production well.

20 Claims, 7 Drawing Sheets

(56) References Cited

OTHER PUBLICATIONS

Wang, et al., Abstract, "Application of a Novel Polymer System in Chemical Enhanced Oil Recovery (EOR)", Colloid and Polymer Science, Springer, Oct. 2003, vol. 281, No. 11, pp. 1046-1054.

"Enhanced oil recovery", from Wikipedia, URL en.wikipedia.org/wiki/Enhanced_oil_recovery.

"Extraction of petroleum", from Wikipedia, URL en.wikipedia.org/wiki/Extraction_of_petroleum.

* cited by examiner

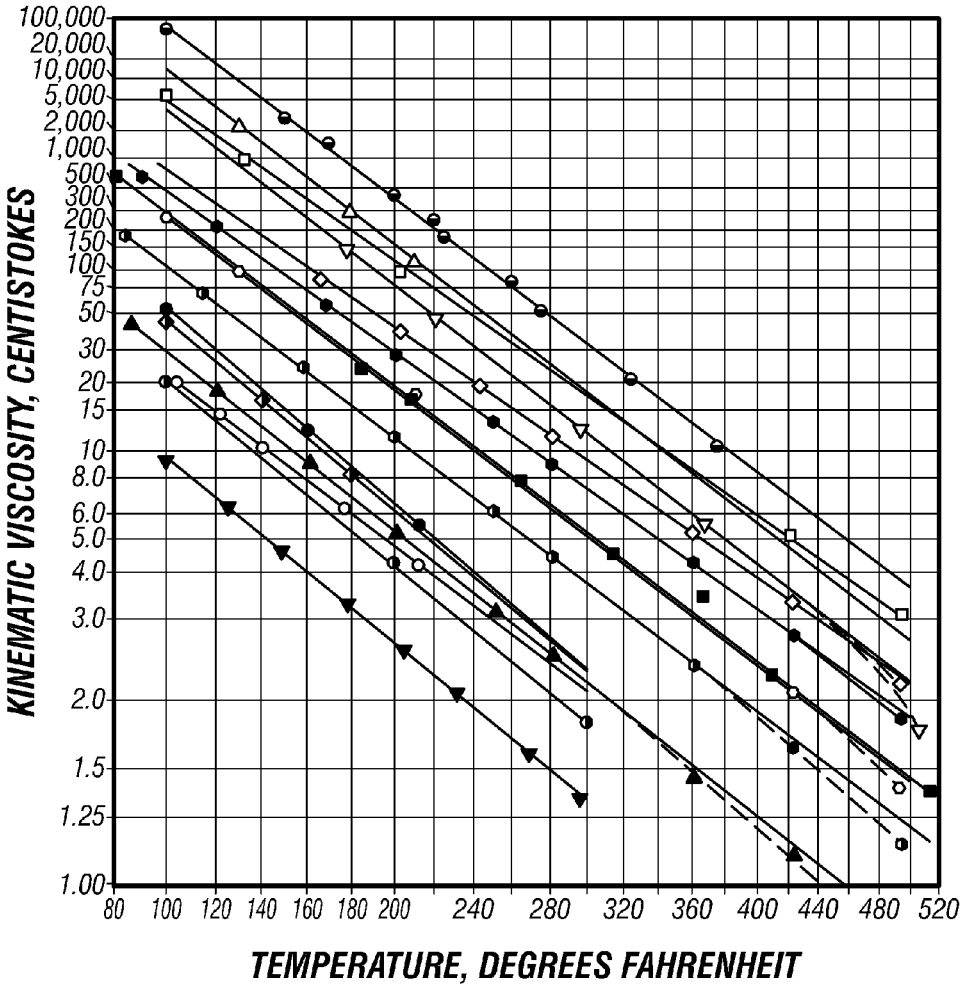

| | | | |
|---|---|---|---|
| 1. ⊖ - CALIFORNIA CRUDE | (9.9 ° API) | 9. ◐ - MIDCONTINENT RED OIL | (24.0 ° API) |
| 2. △ - COLOMBIAN CRUDE | (10.9 ° API) | 10. ● - SOUTH TEXAS CRUDE | (17.8 ° API) |
| 3. □ - MIDCONTINENT RESIDUUM | (14.5 ° API) | 11. ◆ - GULF COAST CRUDE | (20.5 ° API) |
| 4. ▽ - CALIFORNIA CRUDE | (13.4 ° API) | 12. ▲ - MIDCONTINENT LIGHT PARAFFIN OIL | (28.7 ° API) |
| 5. ◇ - MIDCONTINENT CYLINDER STOCK | (22.0 ° API) | 13. ○ - PENNSYLVANIA VACUUM DISTILLATE | (32.7 ° API) |
| 6. ● - MIDCONTINENT HEAVY MOTOR OIL | (23.5 ° API) | 14. ◐ - WYOMING CRUDE | (21.4 ° API) |
| 7. ■ - GULF COAST CRUDE | (15.1 ° API) | 15. ▼ - MIDCONTINENT PRESSED DISTILLATE | (29.2 ° API) |
| 8. ○ - NORTH LOUISIANA HEAVY CRUDE | (18.3 ° API) | | |

FIG. 1
(Prior Art)

MULTI-STAGE ENHANCED OIL RECOVERY PROCESS

BACKGROUND

1. Technical Field

The present technology relates to an improved process for recovery of hydrocarbons from a porous formation or reservoir. More particularly, the technology relates to a multi-stage process for enhanced recovery of high viscosity oil from low temperature subterranean reservoirs by applying enhanced chemical techniques to produce the oil.

2. Description of Related Art

In recent years there has been an increase in the price of crude oil, albeit that the increase has not been steady, but has been subject to the vagaries of politics, economics of supply and demand, speculation, and a host of factors. In general, however, few would argue that the price is not on a general upward trend. The price increase seems to coincide with steady and often spectacular economic growth of nations that had not previously been major consumers of energy, and particularly not of transportation fuels. The demand from these growing nations appears to place a strain on supply and has been cited as a contributing factor, at least, of the general increase in the price of oil over recent years.

The availability of oil reserves and oil production (supply) depends to a large extent on the price that consumers are willing to pay for the oil and/or products derived from the oil. As the price increases, reserves that had not previously been attractive to exploit, from a purely economic standpoint, become more attractive to produce. For example, very deep-off shore wells are expensive and require a high oil price to justify the capital expenditure and the risks associated with drilling miles under the ocean floor. Modern seismic technologies might minimize the risk of a "dry hole" costing tens of millions of dollars to drill, but the risk of loss is not zero. Moreover, while drilling might be economically justified at a projected price, based on the best available data, that projection may yet turn out to be wrong for a number of reasons, including market forces, advances in other technologies (e.g. alternative energy, conservation technologies), an unexpected global economic downturn, etc. Thus anticipated profits may turn into realized losses.

At the outset, the cheapest sources are usually large oil fields on land that produce prodigious amounts of sweet (low sulfur content), light oil (i.e. oil having a low viscosity, and low specific gravity or high API), under reservoir pressure. The discovery of new oil fields that meet this description, and that are in politically stable regions of the world to facilitate exploitation, appears to be dwindling. Alternatives to these ideal sources are reservoirs that require assistance by pumping out the oil, which adds operating costs. Other alternatives are producing sour (high sulfur) crude oils or heavy (low API) crude oils which are generally more expensive to refine into transportation fuels. Such crude oils also have a relatively lower inherent capability to be processed into transportation fuels as compared to sweet, light crude oils. Indeed, to ease processing severities at refineries, light sweet crude oil is often blended with heavy, sour crude oil to form a blend that facilitates processing into transportation fuels.

When prices continue to increase, yet more techniques for oil production become economically viable. For example, a significant proportion of the original oil in place in many oil-bearing subterranean formations remains in place after primary and secondary (pumping-assisted) production. With a sufficiently high market price, recovery of such residual oil becomes viable. Formations may be of such non-uniformity as to porosity, that some residual oil is trapped in hard-to-reach zones of the reservoir. Many factors affect the proportion of oil that is readily removed from a reservoir under self-pressure and under pumping conditions.

At a sufficiently high price, recovery of much heavier, high viscosity oil reserves may also become viable. These reservoirs may be untouched and may even be accessible, and/or in shallow formations, but may have required such expensive treatment to remove oil as to not be economically viable. Moreover these oils may not have the best refining properties for making high value transportation fuels, for example. The main factors affecting the production of high viscosity crude oils, aside from global political factors, are simply the market price for the particular kind of oil, and the costs of recovering the oil.

Over more recent years, as the price of oil has generally increased (from the low prices of the early 1980s) many techniques have been developed to recover oil that might not have been viable to recover at lower prices. Often, these techniques are all referred to as enhanced oil recovery ("EOR") techniques. These techniques are often customized for a particular reservoir, the nature of the oil to be recovered, its market price, and the costs of recovery, which may include not only direct EOR costs but also environmental remediation, protection, maintenance and related costs.

An example of an EOR used to recover heavy oil or residual oil, includes the step of heating underground formations to reduce the viscosity of the oil and improve its ability to flow through the reservoir to a production well. The relationship between oil temperature (y-axis) and kinematic viscosity (centistokes, x-axis) is illustrated in FIG. 1. The graph is logarithmic and indicates the large reductions in kinematic viscosity achievable through increases in temperature for a wide range of crude oils. For example, for California (heavy) crude (top line of graph) increasing the temperature from 100 to 140° F. decreases the viscosity from about 80,000 centistokes to about 5,000 centistokes. This is a 94% reduction for 40° F. increase in temperature. In contrast, heating paraffin (lowest line of graph) from 100 to 140° F. decreases viscosity from 9 to 5 centistokes, or about 44%. This is significant, but clearly heating a heavy crude oil has a much more significant effect on both absolute, as well as percentage, viscosity reduction.

There are many variations of applying heat to a reservoir, including cyclic steam injection, continuous steam injection, or even hot water injection. Each has advantages and disadvantages in specific situations. Since hot water is not as hot as steam, heat losses are less with hot water injection. But, steam having much higher thermal energy due to the latent heat of conversion from water to steam, is able to apply far more heat per pound injected. Steam, having a lower viscosity that water has a greater tendency to "channel" or "finger," by following a path of least flow resistance. This means that regions outside of this flow path may not be exposed to the steam, whereas these regions may be accessible to hot water. Heat may also travel through the formations of the reservoir by conduction and convection, aside from heat transfer from the hot fluid directly to the formations that it contacts.

Another EOR technique is gas injection. In this technology, gases may be used to expand in a reservoir and thereby push additional oil to a production well. Or, gases that dissolve in the oil to lower its viscosity and improve its flow rate may be injected into the reservoir. One of the gases that may be used is carbon dioxide, and often in the form of a supercritical fluid. As a supercritical fluid, carbon dioxide is able to extract (or "leach") oil from formations, commingle with oil in the reservoir, and sweep the extracted and commingled oil to the production well.

As a further alternative, chemical injection and extraction may be used as an EOR technology. In general, the chemical technologies include polymer flooding, surfactant-polymer flooding ("SP"), and alkaline-surfactant-polymer flooding ("ASP") of the subterranean reservoir.

Polymer flooding includes injecting an aqueous (usually) solution of a polymer into a subterranean reservoir formation. Polymers provide "mobility control" within the reservoir. The addition of the polymer increases the viscosity (i.e., reduces the "mobility") of the solution in which it is dissolved or carried, and thereby minimizes the tendency to "channeling" or "fingering" by seeking the easiest path (path of least flow resistance) through the underground formations. The sought-after oil most likely will be off path of least flow resistance and in regions of the reservoir that are not so easily approached, because of many structural reasons, including for example low porosity, making the oil inaccessible to a low viscosity (high mobility) fluid. By reducing the mobility of the injected solution, the polymer solution minimizes channeling of the water through the reservoir, spreading the flow more broadly horizontally and vertically throughout the reservoir formations. Thus, it potentially provides a more efficient sweep of any remaining oil in the reservoir.

The most commonly used polymers are hydrolyzed polyacrylamides (HPAM), which are polyelectrolytes having a molecular weight in the range 1 to 20 million, or 10 to 25 million. However, many variables may indicate an alternative choice. The polymer concentration may be adjusted to achieve a desired mobility for the desired extent of formation penetration and flooding.

Going a step further, adding a surfactant to the polymer solution reduces the inter-facial tension (IFT) at the oil-water interface and permits higher oil recovery. (IFT is a significant parameter, as discussed in more detail below). Surfactant molecules are characterized in having a backbone, with a lipophilic (oil-soluble) moiety and a hydrophilic (water-soluble) moiety attached to the backbone. Generally, surfactants are classified as non-ionic, cationic, anionic or zwitterionic. In the EOR processes, the tendency has been to use non-ionic or anionic surfactants. The anionic surfactants exhibit a negatively charged region that reduces its attraction to silica, clays, and other components of reservoir formations, which are also negatively charged. As a result, there is low retention of these surfactants on reservoir solids.

In the reservoir, lypophilic moieties of the injected surfactant interact with the oil (often to form a micro-emulsion, as discussed in more detail below). The overall effect is to enhance commingling of the injected surfactant-polymer solution and the oil and thereby improve oil recovery at the production well. The surfactant-polymer formulation may be adjusted for viscosity and the level of surfactant activity desired. Micro-emulsions may interfere with surfactant performance. Micro-emulsions associated with heavy crude oil are often viscous and exhibit non-Newtonian flow characteristics. These properties may adversely affect surfactant performance, injected liquid distribution in the formation, and oil recovery. Generally, to resolve any micro-emulsion issues, a co-solvent is often added to the injected surfactant-polymer formulation. However, this increases the costs of the EOR processes.

The most commonly used surfactants include ether sulfates, the stabilized ether sulfates (above 25° C.), internal olefin sulfates (IOS), and alcohol alkoxy sulfonates. In the latter, the hydrophilic-lipophilic balance may be controlled by the ratio of ethylene oxide to propylene oxide in the molecule.

It has been noted that high viscosity, heavy oils, in particular, are often acidic. The acidic nature of such oil deposits can be neutralized by alkaline chemicals to form in situ soaps. Therefore, when there are acids in the crude oils, such as naphthalenic acids, then flooding the reservoir with a solution that includes an alkaline-surfactant-polymer (ASP) formulation converts at least some of these acids in the oil to soaps. This reduces the IFT and could thereby increase oil production. Moreover, loss of surfactant due to adsorption (onto the reservoir solids) is reduced in the high pH conditions created by the alkali. In this formulation, there are several variables that may be tailored including the concentrations of the alkaline medium (and which particular medium, e.g. sodium carbonate, sodium hydroxide, sodium ortho-silicate, etc.) the nature and concentration of the polymer and surfactant and the desired viscosity/mobility of the solution.

In a further improvement to the ASP processes, a co-solvent is added to improve surfactant performance. The improvement can result from several effects: a reduction in micro-emulsion viscosity, disruption of gel and crystal formation, improving coalescence of the micro-emulsion, and improving aqueous stability of the surfactant solutions. Typically, a low molecular weight alcohol, such as iso-butanol is used as the co-solvent. The appropriate concentration of alcohol depends upon temperature, and on a range of other variables, often requiring a systemic study to determine. Moreover, alcohols, having low flash points, may also introduce flammability issues in the field. Therefore, higher molecular weight alcohols or ethers, such as diethylene glycol butyl ether (DGBE), are preferred.

A challenging issue, briefly mentioned in the outline above, is the presence of highly viscous micro-emulsions in highly viscous heavy crude oil reservoirs. A micro-emulsion is generally defined as a thermodynamically stable liquid phase formed when oil, water and a surfactant commingle to form a liquid containing all three components. Micro-emulsions are characterized as Type I, Type II, or Type III. A Type I micro-emulsion is an oil-in-water emulsion where a portion of the oil is solubilized by surfactant micelles. Type II is a water-in-oil emulsion where a portion of the water has been solubilized in the surfactant micelles. Type III is a bi-continuous emulsion containing both water and oil solubilized in the surfactant micelles. Being thermodynamically stable, these micro-emulsions do not readily break down into separate oil and water phases. But, they can shift from one type to another depending upon factors, such as, for example, the salinity, temperature, pressure, surfactant nature and concentration, the amount of oil and the equivalent carbon alkane number (EACN) of the oil. A Type III micro-emulsion is preferable over the other types because it has the highest solubility ratios (more water and oil are solubilized with the surfactant), which also gives the lowest IFT, thereby suggesting it is more efficient in oil recovery. Generally, a shift from Type I to Type III can be achieved by increasing salinity, increasing surfactant lipophilicity, decreasing pressure, decreasing temperature (for anionic surfactants). However, the predominant parameter is the EACN of the oil. Thus, adding a light hydrocarbon (e.g., methane or another alkane having from 2 to 10 carbon atoms) reduces the EACN number of the crude oil allowing a transition from Type Ito Type III.

The solubilizing properties of surfactants play an important role in micro-emulsion formation. As mentioned before, one of the factors that influence surfactant-oil interaction is the inter-facial tension ("IFT") which is a parameter that relates directly to solubilization. Generally, a good system with a high solubilization ratio would have a large Type III micro-emulsion phase and would give an IFT of $10^{-3}$ dyne/cm, which is required to displace the oil down to a residual saturation near zero.

It is believed that both the IFT and the micro-emulsion viscosity are significant variables in EOR. Micro-emulsion viscosity is significant in surfactant retention in the formations of the reservoir, pressure gradients, sweep efficiency, and chemical slug mobility. The viscosity of the micro-emulsion often has a maximum near the point where the oil and water concentrations in the emulsion are about equal. Reduction in micro-emulsion viscosity would reduce the possibility of phase trapping and surfactant retention in the reservoir, and is therefore beneficial to an increase in oil recovery. However, these micro-emulsions are thermodynamically stable and reduction in their viscosity presents challenges.

As noted above, oil economics drives the applicability of oil recovery technologies so that once-unattractive sources become viable. It is well-known that there are relatively shallow reservoirs that contain highly viscous oils. The high viscosity of the oils presents a challenge to their extraction. And, the high viscosity and low proportion of lighter oil components, which are easily processed into transport fuels, also present an issue with regard to market price and refining. In many cases, these shallow reservoirs occur at a depth of less than 1,000 feet (330 meters). The high viscosity of the oil and the cold subterranean formation conditions present technical and economic challenges to the extraction of this oil, even as oil prices continue to rise.

SUMMARY

The following is a summary of some aspects and an exemplary embodiment of the present multi-stage oil-recovery technology, of which a more detailed explanation is provided under the Detailed Description section, here below.

An exemplary embodiment provides a multi-stage method for recovery of oil from a subterranean formation that has a reservoir containing high viscosity oil at low temperatures. The method includes the step of at heating at least a portion of potentially extractable hydrocarbon deposits within the reservoir, by injecting a sufficient amount of a heating fluid. The heating fluid is at a temperature and viscosity (mobility) sufficient to minimize channeling of the heating fluid through the reservoir and to permit penetration of the heating fluid into regions of the reservoir containing potentially extractable hydrocarbon deposits, such as high viscosity oil. This is followed by injecting into the reservoir an extraction fluid that includes either a surfactant-polymer formulation or an alkaline-surfactant-polymer formulation, in an amount and at a viscosity sufficient, under conditions in the reservoir, to extract hydrocarbons, such as high viscosity oil from the reservoir. The surfactant-polymer formulation, or an alkaline-surfactant-polymer formulation, forms "mobile emulsions," without need for a co-solvent, with the heated extractable hydrocarbons. Further, the method includes injecting into the reservoir a drive fluid that includes a polymer for mobility control. This polymer drive fluid is injected in an amount and at a viscosity sufficient, under conditions in the reservoir, to displace hydrocarbons and other fluids from the reservoir. Optionally, the polymer drive fluid may be injected as a heated slug, or at least an initial portion of the slug may be heated, while the subsequently injected portion of the slug is not. This is followed by injecting an aqueous driving medium into the reservoir in an amount sufficient to drive fluids from the reservoir. Additionally, the method includes the step of continuously recovering oil as the sequential steps above are being carried out.

The foregoing summary is not exhaustive; more details and exemplary embodiments about the multi-stage enhanced oil recovery technology that is the subject of the appended claims are provided here below.

BRIEF DESCRIPTION OF THE DRAWINGS

The following drawings depict exemplary, non-limiting embodiments that are intended to facilitate an understanding of the inventions, which are set forth in the appended claims. The technology may be best understood by reference to the following Detailed Description, when read in conjunction with the accompanying illustrative, not-to-scale drawing, wherein:

FIG. 1 is a (prior art) graph showing the variation of kinematic viscosity (x-axis) in centistokes with temperature (y-axis) in degrees Fahrenheit for oils ranging from heavy crude oil to light paraffin oil.

DETAILED DESCRIPTION

Figure 2A:
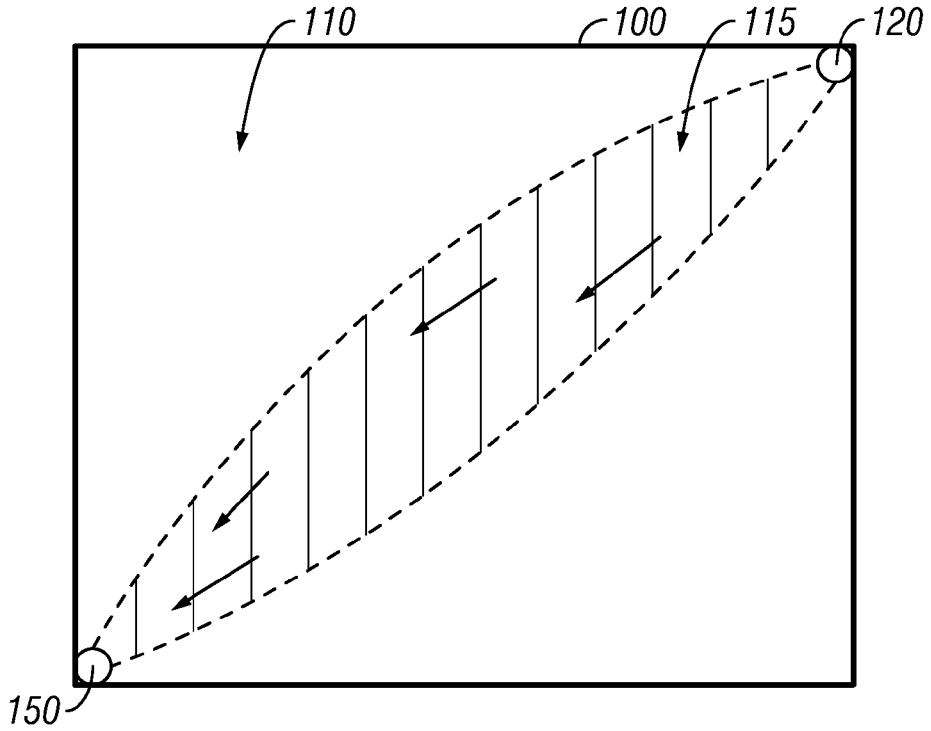
FIG. 2A is an illustrative representation of a plan view of a (quadrant) section of a drilling site showing a shallow reservoir of high viscosity crude oil in a cold region and the limited region through which fluid channels through the reservoir.

Exemplary embodiments of multistage oil recover technology will now be described with reference to the drawings. Unless otherwise noted, like elements will be identified by identical numbers throughout all figures. The technology illustratively disclosed herein suitably may be practiced in the absence of any element which is not specifically disclosed herein.

The term "exemplary" as used herein, means "an example of," and the examples provided herein are non-limiting of the invention, which is solely expressed in the patent claims.

The technology described herein provides a multi-stage process for recovering high viscosity oil from subterranean reservoirs, or residual heavy oil trapped in subterranean formations. The process is especially (but not only) applicable in the recovery of oil from low temperature reservoirs with high viscosity oils. This technology may be particularly well suited, for example, for use in Canadian reservoirs where the reservoir temperature is about 15° C. and the oil has a relatively high kinematic viscosity, in some cases up to about 100,000 centistokes. Accordingly, such oil is not easily recovered by traditional techniques of secondary or tertiary recovery.

In the specification and the claims, a "high viscosity oil" means a naturally-occurring hydrocarbon mixture, like crude oil, that has a viscosity of more than about 2,000 centistokes at about 100° F. (40° C.), or in the prevailing natural temperature conditions in the reservoir from which it is to be extracted, i.e., under the natural conditions at which it exists before applied heat for extraction. Thus, the term is also applied herein, for the sake of consistency, to high viscosity oil after it has been heated to reduce its viscosity substantially because it is still the same oil despite its "heat induced" reduction in viscosity. The term also includes residual oil remaining in a reservoir where at least primary extraction has already taken place.

In the specification and claims, a "shallow formation" having an oil-bearing reservoir means a formation at a depth of up to about 3,000 ft. (1,000 meters).

In the specification and claims, a "low temperature" referring to a subterranean formation or reservoir means a temperature less than about 50° C. (120° F.), and includes especially those reservoirs where the temperatures are about 15° C. to about 20° C. (59° F. to 68° F.) or less. In general, a low temperature is one at which a surfactant does not readily (in commercially useful terms) form an emulsion with the oil in situ.

In the specification and claims, a "mobile emulsion" means an emulsion in a reservoir that is mobile under the present multi-stage enhanced oil recovery technology. In particular, a mobile emulsion is one that will be driven to a production well by a drive medium, such as a water drive, and is not so viscous as to resist the drive forces. In general, it may contain micro-emulsions and possibly some macro-emulsions due to admixture with other liquids (such as high salinity brine, for example).

In the specification and claims, the term "extractable hydrocarbons" or "potentially extractable hydrocarbons" means high viscosity oil that is extractable, or potentially extractable, using the multi-stage enhanced oil recovery technology presented herein.

Recovery of high viscosity oil from subterranean formation poses significant challenges. The high viscosity most often renders the oil incapable of flowing readily to a production well. This condition is exacerbated when the subterranean formation is at a low temperature. From FIG. 1, as discussed above, heating high viscosity oil is known to reduce its viscosity, thereby increasing its capability to flow and potentially be recovered from a subterranean formation where it is held in place by both its own viscous properties and the sometimes limited permeability of regions of the formation. However, as explained here below, according to exemplary embodiments of the multi-stage enhanced oil recovery technology, reduction in viscosity through heating is a side-effect, and while beneficial, it is not the primary purpose of applying heat.

As discussed above, the formation of the Type III micro-emulsion is critical to the formulation of efficient SP and ASP systems (reduce oil saturations to nearly zero) but there are also some concerns about the micro-emulsion systems, such as the high viscosity. It has been found that for highly viscous oils at lower temperatures, the Type III micro-emulsion is difficult to form and it is also difficult to move or drive such emulsions due to their high viscosity, when they do form. Therefore, a co-solvent may have to be added to the SP or ASP system to improve the phase behavior and the rheological properties of the micro-emulsion. However, adding co-solvent is expensive and may also pose safety issues. It has now been found that mildly heating up the high viscosity oil in oil-bearing formations not only improves the phase behavior, but also reduces the micro-emulsion viscosity. This phenomenon of using heat to form a reduced viscosity micro-emulsion in the presence of a suitable surfactant, without the use of co-solvent, provides a very effective enhanced oil recovery process for high viscosity hydrocarbons. The heating of the potentially extractable hydrocarbons is, therefore, according to exemplary embodiments primarily to assist in the action of the surfactant with the high viscosity oil to thereby form a reduced viscosity emulsion (a "mobile emulsion") in situ. Such a micro-emulsion is mobile and is much more easily produced from the reservoir. An added or incidental benefit of heating, but not its primary benefit, is the reduction in the oil viscosity that makes the oil much easier to displace from regions throughout the reservoir for recovery.

FIG. 2A illustrates a quadrant 100 of an oil field that has a production well 150 and an injection well 120. The oil field is shallow and in a cold region, and is at a temperature of about 15° C. Fluid injected at the injection well can be seen to channel in the (shaded) region 115, which is only a small portion of the expanse of the oil-bearing region 110 between the injection well 120 and the production well 150. Thus, the extraction region 115 is severely restricted by channeling.

Figure 2B:
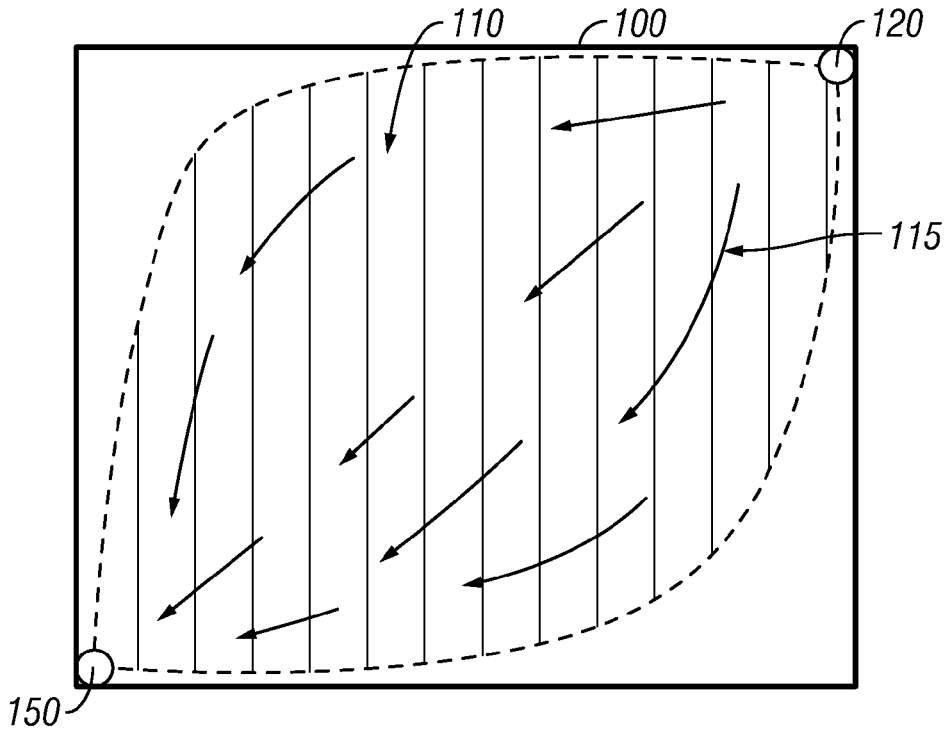
FIG. 2B is an illustrative representation of a plan view of the quadrant section of the reservoir of FIG. 2A showing the much expanded region of fluid flow and oil extraction when using an exemplary embodiment of the multi-stage enhanced oil recovery technology.

FIG. 2B illustrates the dramatic improvement achieved by using an example of the multi-stage enhanced oil recovery technology presented herein. The extraction region 115 is now far broader, extending widely across the oil-bearing region 110. The extraction region now encompasses virtually the entirety of the oil-bearing region 110 between the injection well 120 and the production well 150. Thus, oil can be displaced and removed from the reservoir effectively and efficiently, leaving a minimal residual of less than 10% original oil in place, or less than 5% in swept zones in some cases.

According to exemplary embodiments, in order to create the conditions for the formation of a stable, mobile emulsion, in the presence of a surfactant (without adding co-solvents), that is not highly viscous, and that can be driven with relative ease, the hydrocarbons to be extracted, which are at the low reservoir temperature, should be heated. Surfactants do not readily form micro-emulsions under low temperature conditions with high viscosity oils. But, heating enhances the reactivity of surfactants with high viscosity oil and tends to lead to the formation of mobile emulsions, rather than immobile phases, such as gels and liquid crystal emulsions.

The injection under suitable pressure of polymeric formulations (which may include surfactants and alkalinity formulations) provides a viscous, lower mobility medium that is more suitable for forcing entry into those tighter formations within the reservoir that water might channel around. But, the hydrocarbons, being of high viscosity and often forming very high viscosity emulsion phases, such as gels or liquid crystals, when contacted with surfactants, are difficult to move. Moreover, when a polymeric solution is heated, it undergoes a reduction in its viscosity (increase in mobility). Accordingly, a heated polymeric solution, if its viscosity is sufficiently reduced by heat, may also tend to channel in the reservoir, defeating its purpose of opening tighter formations and removing highly viscous oil from the tighter formations.

Further, the solutions can only be heated to a certain temperature beyond which polymer degradation tends to accelerate. However, if the solution is heated to below the degradation temperature, additional polymer may be added to increase the viscosity of the solution to achieve a desired mobility. In addition, since heating the oil also reduces its viscosity, the mobility ratio (polymer viscosity/oil viscosity) is decreased and this improves the effectiveness of a sweep of the oil from the reservoir.

Based on the foregoing, an exemplary embodiment utilizes a hot polymer solution, of sufficient mobility to penetrate throughout the reservoir with minimal channeling, to provide the thermal energy to heat up the extractable hydrocarbons in the reservoir to a temperature suitable for the formation of a mobile (i.e. not highly viscous) Type III emulsion in the presence of a surfactant, without use of a co-solvent.

Figure 3:
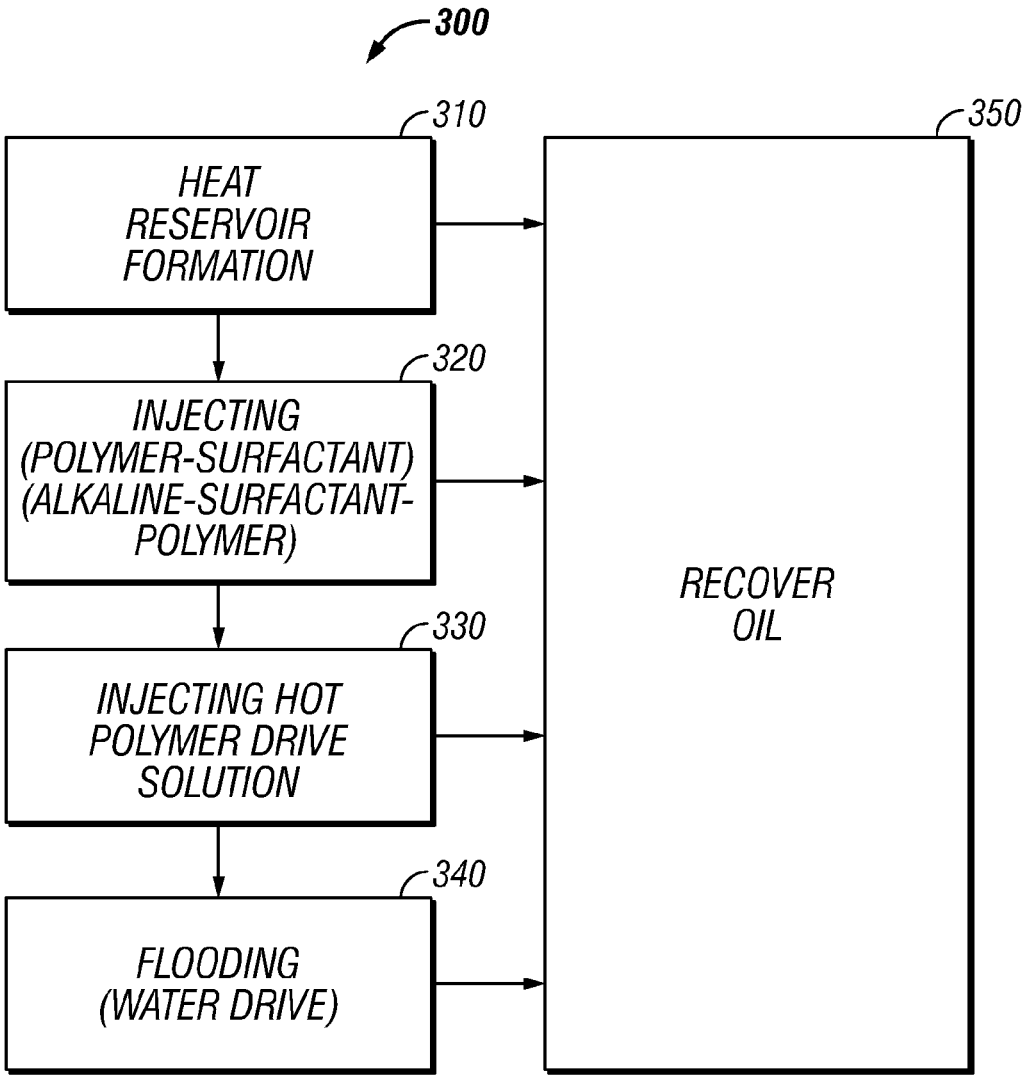
FIG. 3 is an exemplary flowchart showing steps of an exemplary embodiment of a multi-stage method for recovering high viscosity oil from a subterranean reservoir.

FIG. 3 is an illustration of an overview or outline of steps in an exemplary embodiment of a method 300 for multi-stage extraction of high viscosity oil from a subterranean reservoir. The exemplary reservoir is depicted as 240, while the exemplary overlying geological strata are depicted as 220/230 and the exemplary underlying strata beneath the reservoir are depicted as 250. There are several stages in the extraction process, not all of which are essential in each and every exemplary embodiment. The exemplary steps of the methods are continuous in the sense that oil well operations are continuous, involving the continuous injecting and removing of liquids from a reservoir, for example. But each of the injections, while continuously pumped and injected may involve batches of various liquids, each of these liquids having a particular function. The injections may be staged sequentially, in a predetermined order, based on the objectives desired to be achieved.

The purposes and details of each step illustrated in the exemplary embodiment of FIG. 3 will be explained in more detail below. (FIG. 4 may be compared with the description of FIG. 3). Briefly, however, in overview, the method 300 has a step 310 of injecting a heating medium into the reservoir formation. The primary objective of the heating stage 310 is to create the conditions for formation of a mobile emulsion between warmed-up oil and surfactant formulations injected later, without need for co-solvents. A heating medium or fluid is injected to at least partially heat the extractable hydrocarbons, such as the cold high viscosity oil, in the reservoir, in step 310. This heating fluid injection step is followed by injecting either (1) a polymer-surfactant, or (2) an alkaline-polymer-surfactant solution, in step 320. This is followed by injecting a slug of a hot polymer solution, such as a polymer drive solution, for example, in step 330. Optionally, only an initial portion (or "front end") of the polymer drive slug may be heated before injection, while the remainder of the polymer drive slug (or the "back end") may be injected without heating. The advantage of this option is that it conserves energy while at the same time maintaining a higher polymer viscosity (lower mobility) for the back end of the slug. This step is followed by flooding the reservoir 340 with a drive fluid, which may be water, with or without additives, at ambient temperatures. The step of flooding 340 injects a drive medium to drive fluid from the reservoir to a production well. In each sequential step detailed above, as the injected slug travels through the formation from injection well to the production well, oil is produced at the production well, in step 350.

Figure 4:
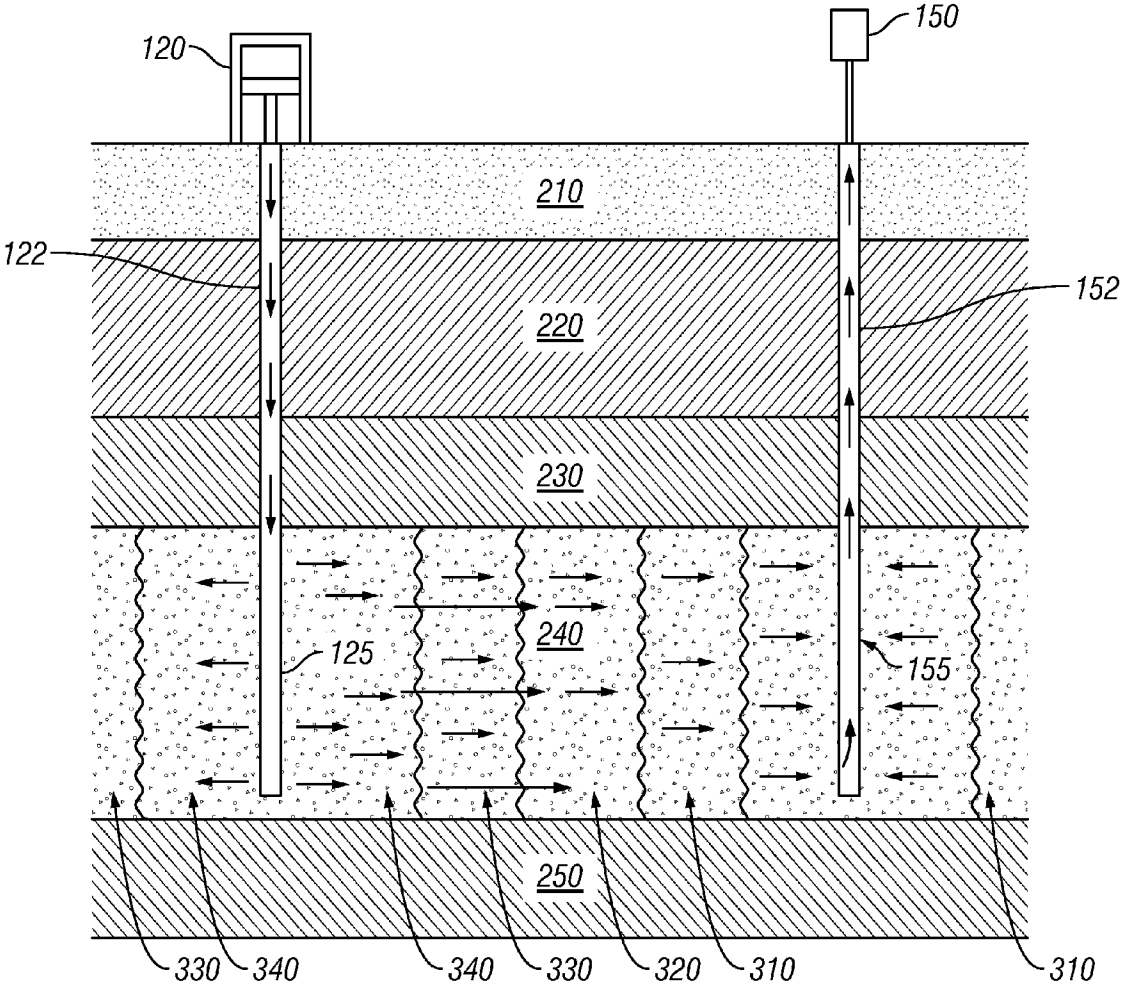
FIG. 4 is an illustrative representation of a cross sectional view of a reservoir showing an injection well and a production well and slugs of injected fluids, in sequence, according to an exemplary embodiment of the multi-stage enhanced oil recovery technology

FIG. 4 is a representative illustration of an exemplary embodiment showing the fluid slugs as they flow from an injection well 120 to a production well 150, and may be read in conjunction with FIG. 3. As indicated in the examples above, the multi-stage enhanced oil recovery technology includes sequential injection of fluids via the injection well 120 through well bore 122 and out of its exit port 125 into the oil-bearing formation 240. FIG. 4 shows the slugs of injected fluids, here represented as though in pure "plug flow" for purposes of simplicity. The first or "leading" slug 310 includes heating fluid, followed by a slug 320 of extraction fluid, which may include either a polymer-surfactant formulation, or an alkaline-polymer-surfactant formulation. This is followed by a slug 330 of a polymer drive fluid. The reservoir drive medium 340 is the final fluid, in this example, and it floods the reservoir with a total amount of about 1.0 to about 1.5 pore volumes and drives all fluids toward the production well. While this exemplary embodiment shows the sequential fluids in slugs, other embodiments may interpose fluids between the depicted slugs. Accordingly, the representational illustration is not limiting of the multi-stage enhanced oil recovery technology.

An exemplary embodiment provides a multi-stage method for increasing high viscosity oil recovery from a shallow, low temperature reservoir. The method includes the step of heating at least a portion of the extractable hydrocarbon components (such as high viscosity oil) in the reservoir by injecting a sufficient amount of a heating fluid having a temperature and viscosity sufficiently high (mobility sufficiently low) to minimize channeling of the heating fluid through the reservoir and to permit penetration of the heating fluid into regions of the reservoir that are otherwise bypassed due to channeling but that contain potentially extractable hydrocarbons, to facilitate chemical treatment. The heating step permits formation of a mobile emulsion, in the presence of a surfactant formulation, without need for a co-solvent. In this exemplary method, heating is followed by injecting a heated extraction fluid that includes at least a polymer-surfactant formulation, or an alkaline-surfactant-polymer formulation, and that does not include a co-solvent. This injected slug of heated extraction fluid follows the path of the prior injected slug of heating fluid in the reservoir formation. The polymer- and surfactant-containing fluid is injected in an amount sufficient, under conditions in the reservoir, to commingle with high viscosity oil, and to extract the oil thereby forming a mobile emulsion with previously heated hydrocarbons. This is followed by injecting a slug of a hot, aqueous drive fluid that may include a polymer, as well as other chemical components in its formulation. The hot drive fluid is injected in an amount and at a viscosity sufficient, under conditions in the reservoir, to displace and drive oil toward a production well. Further, the exemplary method includes continuously injecting an aqueous drive medium into the reservoir in an amount sufficient to drive substantially all previously injected fluids with the mobilized oil to a production well.

In another exemplary embodiment, the heating stage of a multi-stage high viscosity oil recovery method includes heating at least a portion of the potentially extractable hydrocarbons, such as high viscosity oil, in the reservoir with an injected heating fluid that has the capability to penetrate into tight formations within the reservoir and to resist channeling. Thus, one of the properties of the heating fluid is that it should have a sufficiently high viscosity under conditions in the reservoir to carry out the function of formation penetration under pressure, as well as heating. In an example, the heating fluid may be heated water, or in another example, it may be a heated aqueous solution of a polymer formulation, or another additive, which may assist in maintaining a higher viscosity than hot water. The viscosity-increasing polymer or additives may be selected from those known and used in the oil industry in injection processes, or may be another polymer or additive that increases the viscosity of the aqueous solution. In an exemplary embodiment, the fluid may be heated to a wellhead temperature such that the fluid retains a viscosity in the range from about 10 to about 200 cp, or from about 50 to about 100 cp. In general, all other factors being equal, the most effective heat transfer will take place when the heating fluid is at its highest temperature, having the highest temperature differential with the extractable hydrocarbons as a heat transfer driving force, and carrying the most thermal energy. Accordingly, in an exemplary embodiment, since the heating medium might desirably be in a liquid phase and have a viscosity that reduces the tendency to channeling, it may be heated to as close to its boiling point as feasible to increase its thermal energy content, or at least as high a temperature as possible without degrading the polymer or any other additive components. The fluid may, for example, be heated to from about 80° C. to about 90° C. at the wellhead. The duration of the heating step (i.e. the amount of heating medium to be injected in a slug) is predetermined by a calculation based on filling about 5 to 10% of the pore volume of the reservoir.

After the heating stage, an exemplary embodiment injects the extraction fluid that commingles with the (warmed) high viscosity oil to rapidly form a mobile emulsion, preferably a Type III micro-emulsion. This extraction fluid may include either a polymer-surfactant formulation or an alkaline-surfactant-polymer formulation. In an exemplary embodiment, it may be heated to as high a temperature as possible, without degrading the polymers, surfactants, or any other necessary components of the formulation. The polymer-surfactant formulation or alkaline-surfactant-polymer formulation may, for example, be heated to from about 80° C. to about 90° C. (176 to about 194° F.) at the wellhead.

While a wide range of surfactants may be utilized in the polymer-surfactant formulations or alkaline-surfactant-polymer formulations, an alkyl benzene sulfonate surfactant having an average molecular weight of about 400 is preferred in an exemplary non-limiting embodiment. Surfactants of other molecular weights and chemistries are also useful In a further exemplary embodiment, in a post-extraction, polymer drive stage of the multi-stage methods of recovering high viscosity oil, a hot aqueous polymeric drive medium is injected into the reservoir. The drive medium may be a hot liquid that has a viscosity sufficient to minimize the tendency to channel once it is injected into the reservoir. As explained above, optionally, only the front end of the polymer drive slug may be heated while the back end is at ambient temperature. The volume of the injected polymer drive fluid can be predetermined by taking into account the reservoir estimated volume (taking into account pore volume, which is typically 20 to 50%), and a residence time for the post-heating fluid in the reservoir. Thus, the required or sufficient amount of the fluid to inject may be readily estimated. The concentration of any viscosity-modifying components may be adjusted to achieve a target viscosity, as closely as possible, taking into account the effects of heat on viscosity, and the effect of potential cooling once the fluid is in the reservoir, which may yet be at a lower temperature than the injected post-heating fluid. In an exemplary embodiment, the slug of post-extraction polymer drive fluid (or only its front end) may be heated to a temperature such that the fluid retains a viscosity of about 10 to about 200 cp, or about 50 to about 100 cp. In general, all other factors being equal, the most effective penetration into the formations of the reservoir may take place when the polymer drive medium is at a temperature that it has a mobility (i.e. has sufficient viscosity) to minimize channeling through the reservoir. Accordingly, in an exemplary embodiment, it may be heated to as close to its boiling point as feasible to increase its thermal energy content, or to as high a temperature as possible without degrading the polymer, or any other components, to maintain a desired viscosity. The polymer drive fluid may, for example, be heated to from about 80 to about 90° C. at the wellhead.

In an exemplary embodiment, the sufficient amount (or slug) of the fluids to inject in each of the multiple stages of the enhanced oil recovery process may be readily estimated. For example, the preheating slug may be calculated based on filling about 5 to about 10% of the pore volume of the reservoir; the polymer-surfactant or alkaline-polymer-surfactant slug may be based on filling about 20 to about 30% of pore volume; and the polymer drive slug may be based on filling about 20 to about 50% of pore volume.

After the polymer drive, a continuous water drive may be injected. This is continued until an end point is reached. For example, driving may continue until oil content in the production fluid, time elapsed, volume of fluid injected, reservoir temperature, and/or another selected parameter(s) indicate either exhaustion of oil, or that oil recovery is at a level that is no longer significant.

In an exemplary embodiment, the heating stage of the multi-stage enhanced oil recovery process includes use of a skid-mounted heating unit that includes a furnace, a heat exchanger, for example a conventional plate-and-frame or shell-and-tube exchanger, and a tank for holding heating medium, along with ancillaries, such as pumps, lines and control systems. In this embodiment, a heating medium is heated and charged to the heat exchanger where it transfers heat to those liquids that are to be injected hot into the reservoir. The heating medium exiting from the heat exchanger is continuously recycled to the furnace to be reheated and reused to transfer heat in the heat exchanger. In an exemplary embodiment, the heating medium may be a hydrocarbon or water, suitably treated to avoid scaling or other fouling of the furnace or heat exchanger surfaces.

Figure 5:
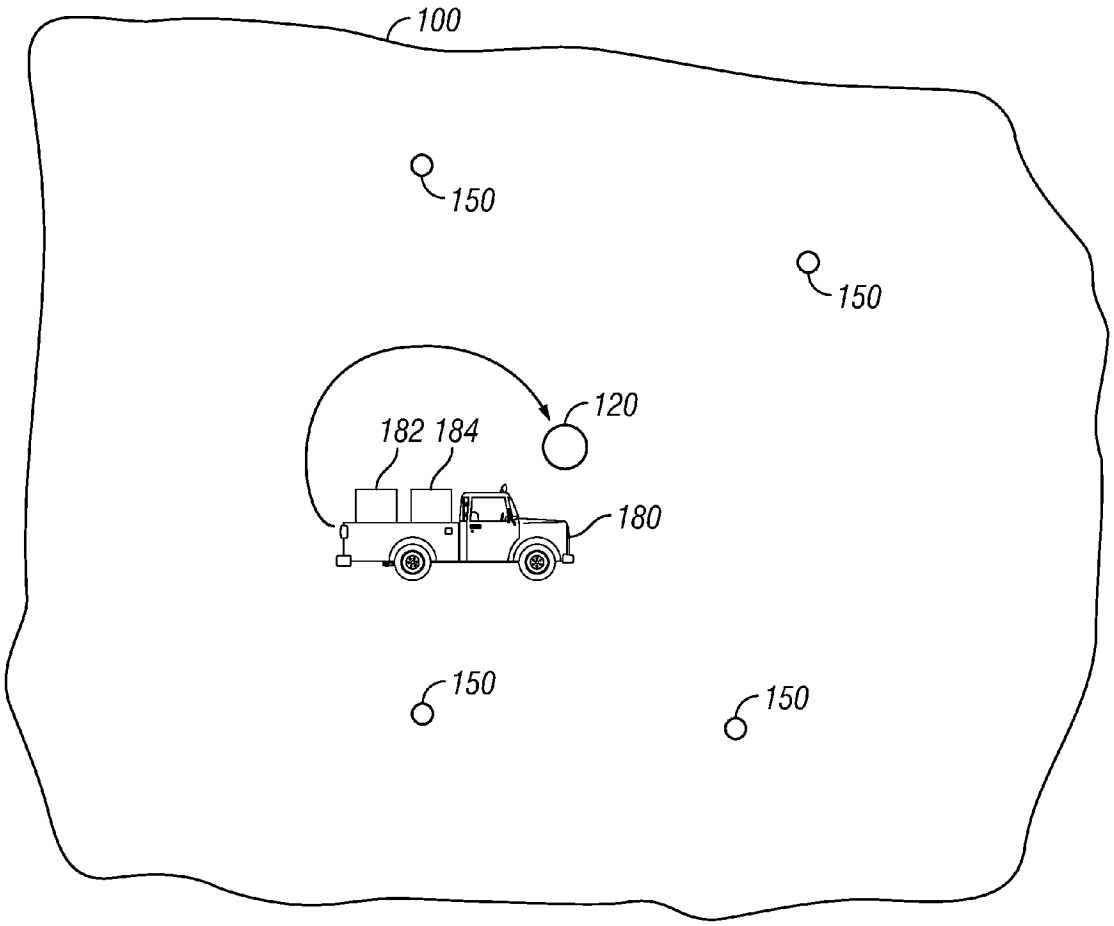
FIG. 5 is an illustrative representation of a plan view of a reservoir showing location of injection and production wells for using an exemplary embodiment of the multi-stage enhanced oil recovery technology.

Referring to FIG. 5, an illustrative aerial view of a portion 100 of subterranean oil bearing reservoir. The illustrative drawing shows a central injection well 120 surrounded by an array of production wells 150. Moreover, in the embodiment shown, a mobile vehicular platform 180 includes a furnace 182 for hot water and hot polymer solutions, as well as tankage 184 for the solutions to be heated. Ancillaries such as pumps, piping and controls (not shown) are provided to facilitate injection of solutions and hot solutions into reservoir via injection well 120. Of course, the provision of hot solutions to the injection well 120 need not necessarily be via a mobile skid-mounted platform. The furnace, pumps, controls and piping to each injection well may be removable to minimize excess equipment costs. In the illustrated example of a mobile embodiment, production (and production rates) at production wells 150 and injection at the injection well 120 takes place in a prearranged sequence to ensure near-uniform, or substantially uniform, flooding and sweeping of oil from the reservoir from the injection well 120 to the production wells 150.

Figure 6:
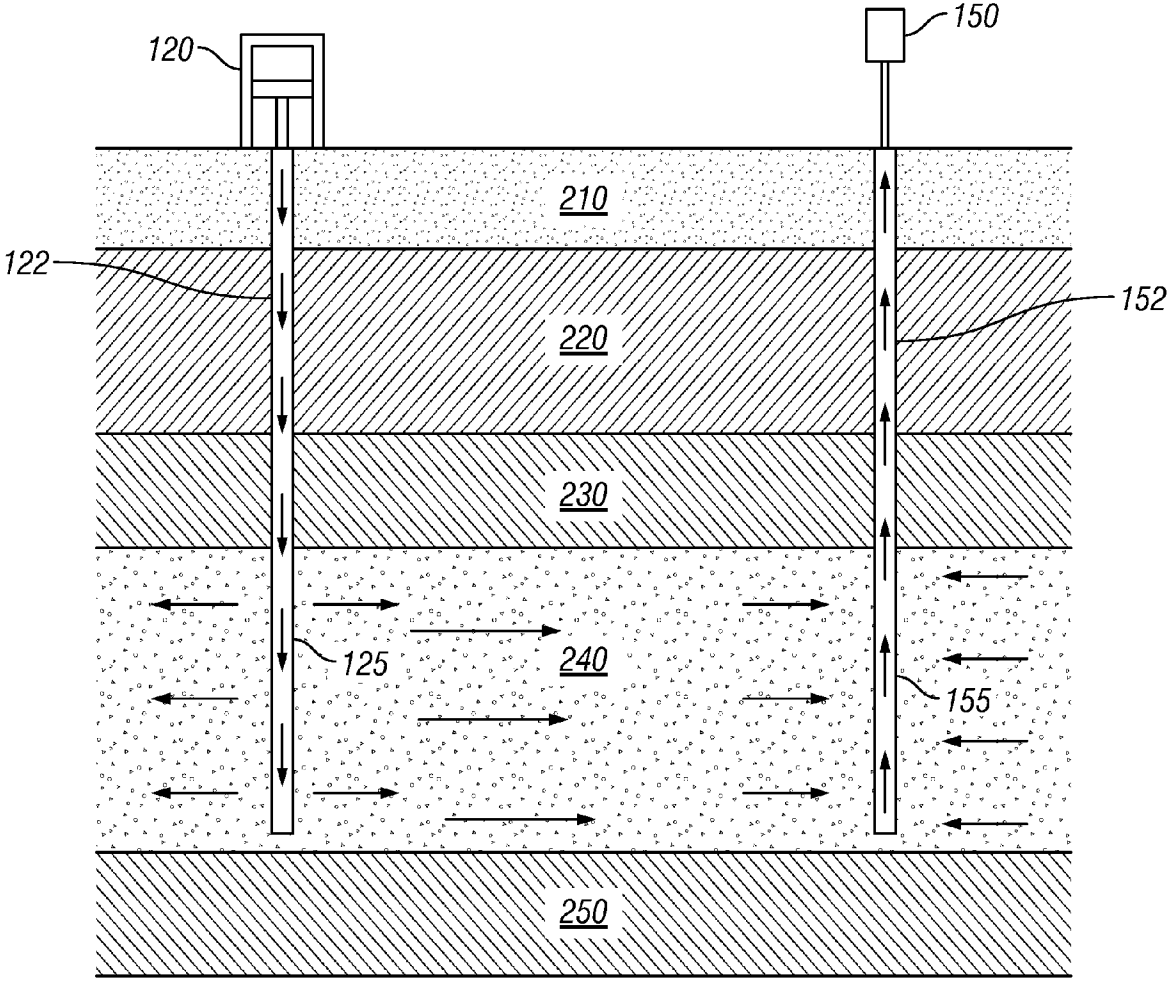
FIG. 6 is an illustrative representation of a cross sectional view of a reservoir showing an injection well and a production well and the extraction zone between these, in an exemplary embodiment of the multi-stage enhanced oil recovery technology.

FIG. 6 illustrates, in a much simplified fashion, the flow of solutions (heating fluid, SP or ASP, polymer drive and drive water) from the injection well 120 down the injection bore 122 into the strata 240 of the reservoir. The arrows depict the flow of these injected liquids from the lower perforated length 125 of the injection bore 122 through the strata 240 to the lower length 155 of the production bore 152. Thus, for example, heating fluid injected into stratum 240 of the reservoir will flow through the stratum 240, with minimal channeling or fingering, and permeate and heat substantially all or at least a portion of any extractable high viscosity oil in the portion of stratum 240 that extends between the injection 120 and production well 150. Similarly, subsequent SP or ASP slug injection will follow these flow arrows (see FIG. 4, for example), displacing the liquid previously pumped in, while extracting high viscosity oil, forming mobile emulsions, and sweeping fluids to the production well 150. The polymer drive, and subsequent water drive, are each a stage of an exemplary multi-stage operation to recover high viscosity oil, and these inject polymer solution, and water, respectively, to drive substantially all remaining prior injected fluids, oil and oil emulsions to the production well 150.

Figure 7:
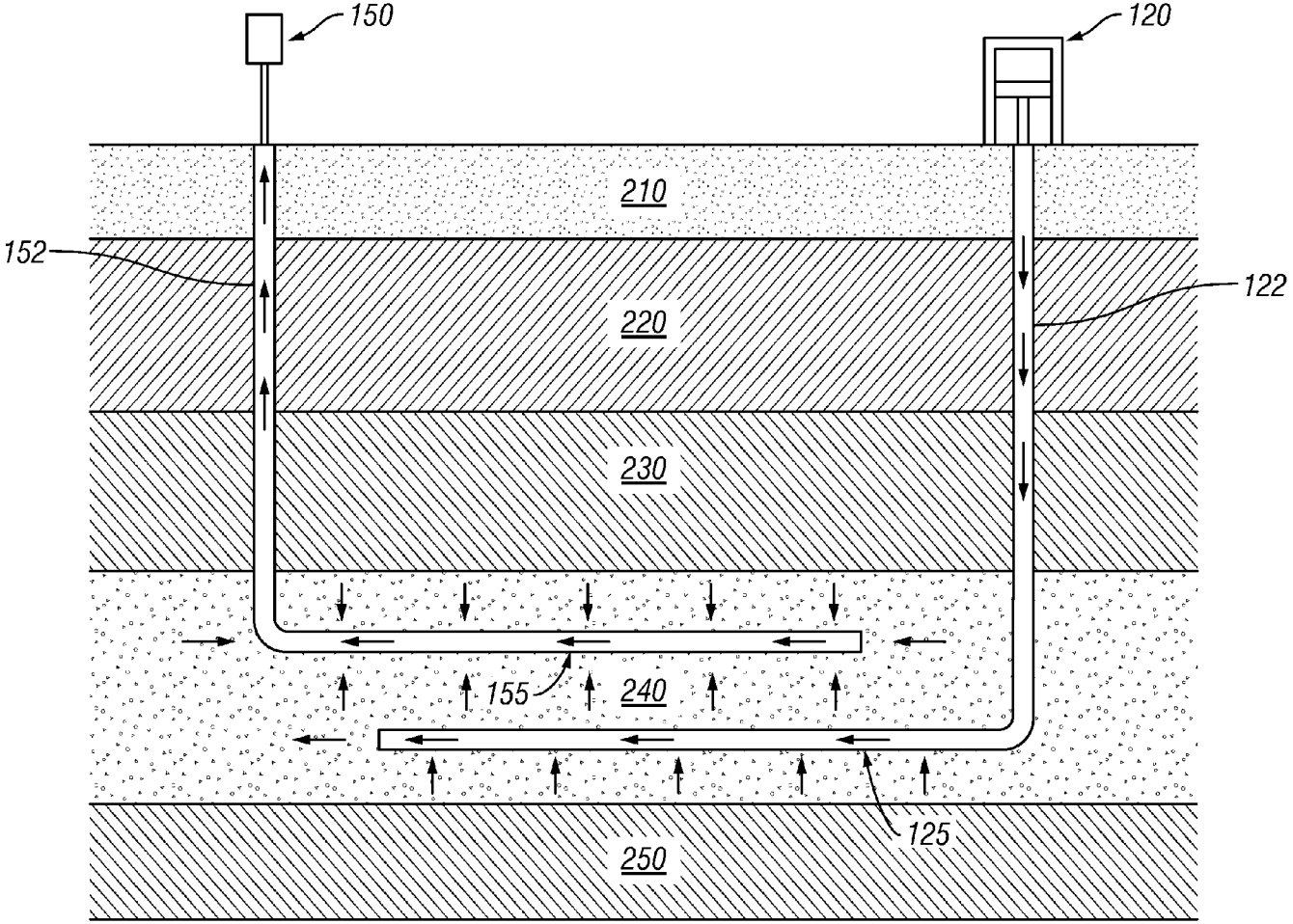
FIG. 7 is an illustrative representation of a cross sectional view of a reservoir showing an injection well and a production well and the extraction zone between these, in another exemplary embodiment of the multi-stage enhanced oil recovery technology.

In another exemplary embodiment shown illustratively, in simplified form in FIG. 7, the production well 150 has a production wellbore 152 that is horizontal. In FIG. 7, solutions (heating fluid, SP or ASP fluid, polymer drive and water drive) flow from the injection well 120, down the injection bore 122, and from horizontal perforated portion 125 into the strata 240 of the reservoir. The arrows depict the flow of these injected liquids from the horizontal portion 125 of the injection bore 122 through the strata 240 to the horizontal perforated portion 155 of the production bore 152. Thus, for example, injected heating polymer solution will flow through the stratum 240, with minimal channeling or fingering, and permeate and heat at least a portion of the extractable high viscosity oil in stratum 240, between the injection 120 and production well 150. Similarly, subsequent SP or ASP injection will follow these flow arrows, displacing the liquid previously pumped in, while commingling with the oil, extracting high viscosity oil, forming mobile emulsions, and sweeping these to the production well. The polymer and water drives follow, in sequence, to drive substantially all remaining prior injected fluids, oil and oil emulsions to the production well 150.

In one exemplary embodiment, extraction of high viscosity oil with the multi-stage method is continued until the residual high viscosity oil in the reservoir is estimated at less than 10% of the original oil in the swept areas. Or, high viscosity oil recovery may be continued until less than 5% of the original oil remains in the swept areas. In other embodiments, depending upon the economics of the operation, including the costs of extraction of the oil and the market price of the oil, the operation may continue until returns diminish to the point that that no significant further gains are achievable.

While exemplary embodiments have been particularly shown and described, it will be understood by those skilled in the art that various changes in form and detail may be made therein without departing from the spirit and scope of the patent claims, and such equivalents thereof that a court may provide under the doctrine of equivalents.

I claim:

1. A method for increasing oil recovery from a subterranean formation having a low temperature reservoir containing hydrocarbons, the method comprising the steps of:

injecting a sufficient amount of a heating fluid having a viscosity sufficient to minimize channeling of the heating fluid through the reservoir and to permit penetration of the heating fluid into regions of the reservoir containing hydrocarbons;

injecting into the reservoir an extraction fluid formulation comprising a surfactant and a polymer, the extraction fluid formulation in an amount sufficient to extract oil from the reservoir;

injecting into the reservoir a polymer drive fluid formulation comprising a polymer, the polymer drive fluid formulation in an amount sufficient to displace and sweep oil and fluids from the reservoir; and recovering hydrocarbons from the reservoir.

2. The method of claim 1, wherein the heating comprises injecting a heating fluid having a temperature in the range from about 80 to about 90° C. at the wellhead.

3. The method of claim 1, wherein the heating comprises heating with a heating fluid having a viscosity in the range from about 10 to about 200 cp.

4. The method of claim 1, wherein the step of injecting a polymer drive fluid formulation comprises injecting a fluid at a temperature in the range from about 80 to about 90° C. at the wellhead.

5. The method of claim 4, wherein the step of injecting a polymer drive fluid formulation comprises injecting a fluid having a viscosity in the range from about 10 to about 200 cp.

6. The method of claim 1, wherein the step of injecting a polymer drive fluid formulation comprises injecting a first slug of heated polymer drive fluid formulation followed by a second slug of unheated polymer fluid formulation.

7. The method of claim 1, further comprising injecting an aqueous driving fluid in an amount sufficient to drive fluids in the reservoir to a production well.

8. The method of claim 1, wherein the subterranean formation comprises a shallow formation, and the hydrocarbons in the reservoir comprises high viscosity oil at a natural in situ temperature in the range less than about 20° C., prior to the step of heating.

9. The method of claim 1, wherein the hydrocarbons in the reservoir comprises high viscosity oil and the step of recovering continues until there is less than 5% residual high viscosity oil in the reservoir.

10. A method for recovery of high viscosity oil from a subterranean formation comprising a low temperature hydrocarbon-bearing reservoir, the method comprising the steps of:

injecting a sufficient amount of a hot first aqueous fluid comprising a polymer into a low temperature reservoir of the formation to heat at least a portion of the hydrocarbons in the reservoir;

injecting into the reservoir a second fluid comprising either a surfactant-polymer formulation or an alkaline-surfactant-polymer formulation, the second fluid having a concentration of surfactant sufficient to form a mobile emulsion with the hydrocarbons in the reservoir, under in situ temperature conditions after the step of heating;

injecting driving fluid in an amount sufficient to drive fluids comprising hydrocarbons to the production well; and recovering hydrocarbons at a production well.

11. The method of claim 10, wherein injecting the hot first aqueous fluid comprises injecting the first aqueous fluid at a temperature in the range from about 80° C. to about 90° C.

12. The method of claim 10, wherein injecting the second fluid comprises injecting the second aqueous fluid at a temperature in the range from about 80° C. to about 90° C.

13. The method of claim 10, wherein the step of injecting a second fluid comprises injecting the fluid in an amount sufficient to fill about 20 to 30% of the pore volume of the reservoir.

14. The method of claim 10, wherein the step of recovering includes recovering oil until residual oil in the reservoir is less than about 5% of the original oil in swept regions of the reservoir.

15. The method of claim 10, wherein the step of recovering includes recovering oil until residual oil in the reservoir is less than about 10% of the original oil in swept regions of the reservoir.

16. A multi-stage method for increasing oil recovery from a subterranean formation comprising a reservoir containing high viscosity oil, the method comprising the steps of:

heating by injecting a sufficient amount of a heating liquid comprising a polymer and having a temperature and viscosity sufficiently high to minimize channeling of the heating fluid through the reservoir and to permit penetration of the heating liquid into regions of the reservoir containing high viscosity oil and to warm the high viscosity oil to above about 20° C.;

injecting into the reservoir an extraction liquid comprising either a surfactant-polymer formulation or an alkaline-surfactant-polymer formulation, the extraction liquid having a concentration of surfactant sufficient to form a mobile emulsion with the warmed high viscosity oil;

injecting into the reservoir a drive liquid comprising a polymer, the drive liquid in an amount and at a viscosity sufficient, under conditions in the reservoir, to displace high viscosity oil and fluids comprising oil from the reservoir;

injecting an aqueous second driving medium into the reservoir in an amount sufficient to drive the fluids comprising oil toward a production well; and recovering oil high viscosity oil and fluids comprising oil at a production well;

wherein the subterranean formation is a shallow, low temperature formation, and wherein the multi-stage method is free of injecting a co-solvent to promote surfactant activity.

17. The method of claim 16, wherein the step of heating comprises injecting a heating liquid in an amount sufficient to fill about 5 to about 10% of the pore volume of the reservoir.

18. The method of claim 16, wherein the step of injecting an extraction liquid comprises injecting the extraction liquid in an amount sufficient to fill about 20 to about 30% of the pore volume of the reservoir.

19. The method of claim 16, wherein the step of injecting a drive liquid comprises injecting the drive liquid in an amount sufficient to fill about 20 to about 50% of the pore volume of the reservoir.

20. The method of claim 16, wherein the step of recovering includes recovering oil until residual oil in the reservoir is less than about 10% of the original oil in swept regions of the reservoir.

* * * * *